US006138981A

United States Patent [19]

Keith et al.

[11] Patent Number: 6,138,981

[45] **Date of Patent: *Oct. 31, 2000**

[54] INSULATING CONNECTORS USED TO RETAIN FORMS DURING THE MANUFACTURE OF COMPOSITE WALL STRUCTURES

[75] Inventors: David O. Keith; David M. Hansen, both of American Fork, Utah

[73] Assignee: H.K. Composites, Inc., American Fork, Utah

[ * ] Notice: This patent issued on a continued prosecution application filed under 37 CFR 1.53(d), and is subject to the twenty year patent term provisions of 35 U.S.C. 154(a)(2).

[21] Appl. No.: 09/128,594

[22] Filed: Aug. 3, 1998

[51] Int. Cl.[7] ..... E04G 17/06; E04G 11/06

[52] U.S. Cl. ..... 249/41; 249/19; 249/214; 249/216

[58] Field of Search ..... 249/214, 216, 249/218, 40, 41, 46, 190, 19; 52/309.11, 309.12, 565, 568, 426, 427, 442

[56] References Cited

U.S. PATENT DOCUMENTS

| | | | |
|---|---|---|---|
| D. 357,855 | 5/1995 | Keith et al. | D8/384 |
| 1,708,634 | 4/1929 | Rees | 249/218 |
| 2,575,079 | 11/1951 | Temple | 85/28 |
| 2,595,123 | 4/1952 | Callan | 25/154 |
| 2,645,929 | 7/1953 | Jones | 72/103 |
| 2,653,469 | 9/1953 | Callan | 72/50 |
| 2,718,138 | 9/1955 | Jones | 72/48 |
| 2,769,333 | 11/1956 | Reintjes | 72/19 |
| 2,775,018 | 12/1956 | McLauglin | 25/131 |
| 2,964,821 | 12/1960 | Meehan | 25/131 |
| 3,426,494 | 2/1969 | Hala | 52/410 |
| 3,523,395 | 8/1970 | Rutter et al. | 52/410 |
| 3,750,355 | 8/1973 | Blum | 52/309 |
| 3,869,219 | 3/1975 | Wilson et al. | 403/282 |
| 4,018,023 | 4/1977 | Anderson | 52/410 |
| 4,157,001 | 6/1979 | Pickles | 52/506 |
| 4,329,821 | 5/1982 | Long et al. | 52/309.12 |
| 4,348,847 | 9/1982 | Jukes | 52/426 |
| 4,393,635 | 7/1983 | Long | 52/309.11 |
| 4,545,163 | 10/1985 | Asselin | 52/378 |
| 4,624,089 | 11/1986 | Dunker | 52/410 |
| 4,702,053 | 10/1987 | Hibbard | 52/309.7 |
| 4,805,366 | 2/1989 | Long | 52/309.11 |
| 4,829,733 | 5/1989 | Long | 52/309.11 |

(List continued on next page.)

FOREIGN PATENT DOCUMENTS

| | | |
|---|---|---|
| 20 24 157 | 12/1971 | Germany . |
| 27 15 277 | 10/1978 | Germany . |
| P 39 25 780 | 2/1991 | Germany . |

*Primary Examiner*—Michael Safavi
*Attorney, Agent, or Firm*—Workman, Nydegger & Seeley

[57] ABSTRACT

Connectors used in manufacturing composite wall structures to substantially prevent forms from being displaced in response to pressure generated by concrete poured between the forms. In a completed composite wall structure, the connectors extend through two structural layers and an insulating layer positioned therebetween. The composite wall structures are formed by positioning the insulating layer between and in a spaced-apart relationship to the two forms. The connectors are subsequently inserted through the insulating layer and the forms. As concrete is then poured into spaces between the forms and the insulating layer, a bearing surface on a form retention segment, which extends beyond the outer surface of the forms, abuts the forms and prevents them from moving away from the insulating layer. The bearing surface is either directly positioned on the form retention segment or on a form locking device attached to the form retention segment. After the concrete hardens, the forms are removed and the form retention segments are optionally detached from the remainder of the connector. The surface of the connectors optionally includes an adhesion promotion material or mechanical anchoring structure to improve the bond between the connectors and the structural layers.

26 Claims, 5 Drawing Sheets

U.S. PATENT DOCUMENTS

| | | | |
|---|---|---|---|
| 4,907,928 | 3/1990 | Beck et al. | 411/387 |
| 4,932,819 | 6/1990 | Almeras | 411/441 |
| 4,945,700 | 8/1990 | Powell | 52/514 |
| 5,011,354 | 4/1991 | Brownlee | 411/439 |
| 5,031,378 | 7/1991 | Murphy | 52/747 |
| 5,094,057 | 3/1992 | Morris | 52/511 |
| 5,209,039 | 5/1993 | Boeshart | 249/40 |
| 5,265,998 | 11/1993 | Kluser | 411/480 |
| 5,519,973 | 5/1996 | Keith et al. | 52/410 |
| 5,606,832 | 3/1997 | Keith et al. | 52/410 |
| 5,673,525 | 10/1997 | Keith et al. | 52/309.11 |
| 5,744,076 | 4/1998 | Baxter | 264/35 |
| 5,809,723 | 9/1998 | Keith et al. | 52/405.1 |

INSULATING CONNECTORS USED TO RETAIN FORMS DURING THE MANUFACTURE OF COMPOSITE WALL STRUCTURES

BACKGROUND OF THE INVENTION

1. The Field of the Invention

The present invention relates to insulative connectors used in the formation of composite wall structures that include an insulating layer and at least one adjacent structural layer. In particular, the present invention relates to connectors for maintaining the forms used to form the wall structures in a fixed position during manufacture and for thereafter securing together the insulating and structural layers after removal of the forms.

2. Relevant Technology

As new materials and compositions have been developed, apparently unrelated materials have been synergistically combined to form useful composite materials. One such example is seen in the area of building and construction, in which high strength structural walls have been coated and layered with highly insulative materials which generally have relatively low structural strength. The resulting composite wall structure has high strength and is highly insulative. Conventionally, the structural component of such as a wall is built first, after which the insulating layer or sheet is attached to the structural component. Thereafter a protective cover is placed over the insulating material to protect and hide it. The insulating barrier reduces the transfer of thermal energy across the composite wall structure.

Concrete is one of the least expensive and strongest materials commonly used in the construction industry. Unfortunately, concrete, which is a mixture of hydraulic cement, water, and an aggregate such as rocks, pebbles, and sand, offers relatively poor insulation compared to many other materials. For example, a slab of concrete having an 8 inch thickness has an R value of about 0.64, while a one-inch thick panel of polystyrene has an R value of about 5.0. The R value of a material is proportional to the thermal resistance of the material and is useful for comparing the insulating properties of materials used in the construction industry.

In contrast with concrete, highly insulative materials, at least those of reasonable cost, typically offer poor structural strength and integrity. While lightweight aggregates having higher insulating ability may be incorporated within concrete to increase the insulating effect thereof, the use of such aggregates in an amount that has a dramatic effect on the insulation ability of the concrete will usually result in greatly decreased strength of the resulting structure.

It has been found that positioning at least one concrete layer adjacent to at least one insulating layer provides a composite wall structure that has both good insulating capability and good structural strength. One strategy for forming these composite wall structures is to position an insulating layer between two concrete layers. This technique, however, poses the risk of allowing the two concrete layers to collapse together or to separate apart during construction or subsequent use of the building. Accordingly, it is necessary to structurally bridge or connect the two concrete layers together. This is conventionally accomplished by using metal studs, bolts, beams, or other connecting devices.

Because metal readily conducts thermal energy, metal studs, bolts, and beams that are used to structurally bridge a pair of structural layers have the effect of significantly reducing the insulating properties of a composite wall. In particular, such metal studs, bolts, or beams provide channels through which thermal energy may be conducted. This is true even though the metal connecting devices may be surrounded by ample amounts of insulating material. Composite wall structures that use metal connecting devices do not prevent heat from flowing from a relatively warm inside wall to a colder outside wall during cold weather, for example, as effectively as composite walls that do not use metal connecting devices. Of course one might construct a building having no structural bridges between the inner and outer structural walls, although the result would be a building having inadequate stability for most needs.

In order to reduce thermal bridging, some have employed connector devices having a metal portion that passes through the concrete layers and a thermally insulating portion that passes through the insulating layer, e.g., U.S. Pat. No. 4,545,163 to Asselin. Others have developed connector devices made entirely from polymeric or other highly insulative materials. Examples of the foregoing include U.S. Pat. No. 4,829,733 to long; U.S. Pat. No. 5,519,973 to Keith et al.; U.S. Pat. No. 5,606,832 to Keith et al.; and U.S. Pat. No. 5,673,525 to Keith et al. For purposes of disclosing insulating connector devices used to secure a composite wall structure together, each of the foregoing patents are incorporated herein by specific reference.

A common technique for forming composite wall structures is known in the art as the "cast-in-place" method, wherein the wall is formed within vertically positioned forms that are erected at or near the location where the composite wall structure is to be finally positioned. In the cast-in-place method the forms and insulating layer are first positioned vertically, after which concrete or other structural material is poured into the spaces between the insulating layer and forms. Connector devices having a length that is equal to or less than the width of the composite wall structure arc placed substantially orthogonally through a vertically oriented insulating layer, with the ends of the connector devices extending out of either surface of the insulating layer. Connectors that are especially useful in manufacturing composite wall structures according to the cast-in-place method are disclosed in the aforementioned U.S. Pat. No. 5,673,525 to Keith et al. Such connectors assist in maintaining the insulating layer at a desired orientation or spacing relative to the forms. This is accomplished by the connector ends making abutment with the inner surfaces of the forms and by means of flanges or other orienting means for maintaining the insulating layer at a desired distance from either of the connector ends. Although the connectors of Keith et al. '525 provide superior benefits as described therein, other connectors, such as those disclosed in U.S. Pat. No. 4,829,733 to Long, could be used in the cast-in-place method.

Existing insulating connector devices used in conventional cast-in-place methods prevent collapse of the forms toward the insulating layer, but do not restrain the forms from moving away from the insulating layer. In order to prevent outward lateral movement of the forms away from the insulating layer, lateral supporting structures such as buttresses and braces must be used. Buttresses and braces can offset the outwardly pushing forces of the freshly poured concrete material against the forms and maintain the forms in a rigid, spaced-apart orientation. However, the use of lateral support structures is time consuming and requires the transport and storage of the relatively heavy and bulky support structures every time a job is begun or completed.

In view of the foregoing, there exists a need for connector devices capable of rigidly restraining motion of forms used in the cast-in-place method in a direction away from the insulating layer and which are small and lightweight compared to conventional lateral support structures.

It would also be an improvement if such connectors included additional features that prevented collapse of the forms toward the insulating layer, particularly prior to filling the spaces between the forms and insulating layer with structural material.

It would be a further advancement in the art if such connector devices for restraining motion of the forms also served the dual purpose of securing the composite wall structure together upon hardening of the structural layers.

The foregoing form-restraining connector devices would be particularly desirable if they were themselves highly insulative in order to not create a thermal bridge between the structural layers.

There is also a need for such form-restraining connector devices that could be manufactured at a relatively low cost per unit.

Such devices for restraining lateral movement of forms during the formation of composite wall structures are disclosed and claimed herein.

OBJECTS AND BRIEF SUMMARY OF THE INVENTION

The present invention is directed to connectors used in the manufacture of composite wall structures. The connectors act to secure one or more casting forms in a rigid position relative to an insulating layer positioned adjacent and/or between the casting forms during the manufacture of composite wall structures. When the connectors arc used to construct a composite wall structure having an insulating layer positioned in the region between a pair of structural layers, the connectors are configured and dimensioned to extend through the insulating layer and also through a pair of casting forms spaced apart from and on either side of the insulating layer. Form retention segments located at each end of the connectors extend through the forms and include a bearing surface or other means for inhibiting outward lateral movement of the forms once the inventive connectors are locked in place. They may optionally include features to prevent inward movement or collapse.

The connectors of the present invention preferably include an elongate shaft comprising a first anchor segment, a second anchor segment, and a mesial segment therebetween. Extending outwardly from each of the first and second anchor segments is a respective form retention segment. During the manufacture of a composite wall structure, the connectors are positioned in a manner so that the form retention segments extend through holes within the forms, while the mesial segment extends through an insulating layer positioned within the region defined by the forms. The first and second anchor segments occupy the molding spaces that initially exist between the forms and insulating layer. Form locking means attached to each of the form retention segments assist in retaining the forms rigidly spaced apart at a desired distance. The connectors may further optionally include means for attaching flanges or other form locking means for maintaining the insulating layer in a desired spaced-apart orientation relative to the inner walls of the forms.

When concrete or other structural material is introduced into the molding spaces, the structural material will envelop the anchor segments of the various connectors. Upon curing or hardening of the structural layers, the anchor segments remain firmly anchored within the structural layers by virtue of anchoring means disposed somewhere along each of the anchor segments. Such anchoring means may include, for example, a recessed portion, protrusion, textured surface, or other mechanical retention structure, or it may include an adhesive material that yields a good bond between the anchor segments and the hardened structural material. In some cases, the inherent bond between cured concrete and plastic without any anchoring structures may be sufficient to retain the connectors anchored sufficiently firmly within the cured concrete structural layers.

After removal of the casting forms, such as by cutting, breaking, separating or otherwise removing the form locking means so that the forms may be separated from the structural layers, at least a portion of the form retention segments may yet protrude from one or more of the structural layers. In order to facilitate detachment of the form retention segment from the completed composite wall structure, the connectors may include a localized area of reduced thickness or strength, or other detachment facilitating means. When stress is applied to the connector by, for example, striking the form retention segment with a hammer or chisel after the composite wall has been constructed, the form retention segment can more easily break off or otherwise separate from the elongate shaft at or near the localized area of reduced strength, which preferably corresponds to the location of the outer surface of the structural layer. Of course, the plastic connectors may be inherently weak enough to break off any protruding ends without an area of weakness, or they may simply be cut off using a saw or snips.

A composite wall structure is constructed in a cast-in-place method according to a preferred aspect of the invention by first inserting the connectors through the insulating layer and forms in a desired spacing, typically in a vertical orientation at or near where the completed composite wall structure is to be located. This may be accomplished, for example, by first positioning the insulating layer and forms in a desired orientation, drilling holes through the forms and insulating layer, and then inserting the connectors through the holes. Thereafter, form locking means are deployed to keep the forms from moving apart and away from the insulating layer and optionally from collapsing toward the insulating layer. Flanges or other orienting means may be optionally attached to the connectors to keep the insulating layer in a desired spaced-apart orientation between the forms. Concrete or other structural material is then poured or otherwise positioned within the molding spaces between the forms and insulating layer. As a result of the form locking means acting in conjunction with the form retention segments, the forms are substantially rigidly held in place relative to the insulating layer.

After the concrete or the other hardenable material has cured or hardened, the forms are removed to expose the completed composite wall structure. In order to remove the forms, the form locking means must be removed from the connectors, either by separating them from the form retention segments or by breaking or cutting off that portion of the form locking means, and perhaps part of the form retention segment, to release the forms. At this point, the remaining form retention segments of the connectors will likely protrude to some degree from the composite wall structure surface. These protrusions may be removed to yield a reasonably smooth wall surface by cutting or chiseling, or by breaking at the aforementioned designed breaking point, between the retention segments and the first and second anchor segments.

In another embodiment of the invention, the connectors may be used in conjunction with connecting devices that do not pass through the forms but which terminate within the space between the forms. For example, connectors having substantially pointed tips like those disclosed in U.S. Pat. No. 5,673,525 to Keith et al. may be used in combination with connectors of the present invention. Connectors such as those used in U.S. Pat. No. 4,829,733 to Long could also be used. Because such connector devices are usually located entirely within the region between the forms, the ends may advantageously abut the forms, thereby helping to prevent the forms from collapsing toward the insulating layer before concrete or other structural material has been placed in the molding spaces between the casting forms and insulating layer. If connector devices having pointed tips are used, they will result in a smoother outer surface of the composite wall structure because concrete can more easily close around a pointed tip compared to a larger diameter end. Such connector devices may advantageously be placed substantially orthogonally through the insulating layer prior to positioning the insulation between the forms. Thus, the connectors of the present invention can, in combination with the shorter connector devices, provide a synergistic combination of functions.

The connectors of the invention are preferably formed from a highly insulative material, which results in highly insulative composite wall structures. For example, the connectors can be formed from high strength resins or other thermoplastics or thermosetting plastics. Preferred thermoplastic materials include polyphenylsufone resins, polyphthalimides, polyamides, polyarylsulfones, polycarbonates, polyphthalamides, polysulfones, polyphenylsulfones, polyethersulfones, and aliphatic polyketones. Less preferred thermoplastics that are nevertheless adequate for most applications include acrylics, polyethylene, polypropylene, acrylonitrile-butadiene-styrene copolymers, polyfluorocarbons, polybutadienes, polybutylene teraphthalates, polyesters, polyethylene teraphthalates, polyphenylene ethers, polyphenylene oxides, polyphenylene sulfides, polyphthalate carbonates, polypropylenes polystyrenes, polyurethanes, polyvinyl chlorides, and polyxylenes.

Preferred thermoset resins include polyester and vinyl esters. Other suitable thermoset materials include diallyl phthalates, epoxy resins, furan resins, and phenolic resins. In addition, copolymers and combinations of the foregoing materials may be used. The criteria used to select the material include sufficient strength and flexibility in order to avoid failure, a sufficiently high R value such that the composite wall structure is adequately insulative, cost, and moldability. In general, thermoplastics and thermosetting plastics provide the advantages of low cost, low weight, and ease of manufacturing. The connectors may be injection molded in one or a minimal number of steps.

Depending on the desired structural properties of the composite wall structures, the connectors may be used in combination with reinforcement materials used to strengthen the structural layers. For example, rebar, wire mesh, fibers, and the like may be attached to notches, hooks, or other structures formed on the connectors. The connectors may further be modified to allow attachment thereto of such reinforcement materials, as described in copending U.S. application Ser. No. 09/020,599, filed Feb. 4, 1998. For purposes of disclosing connectors for attaching reinforcement materials thereto, as well as providing teachings and suggestions as to how one might modify the connectors disclosed herein, the foregoing application is incorporated herein by specific reference.

In view of the foregoing, it is an object and feature of the invention to provide connectors that are capable of restraining the motion of casting forms in a direction away from the insulating layer and which are small and lightweight compared to conventional lateral support structures.

It is a further object and feature to provide connectors that also include features that prevent collapse of the forms toward the insulating layer, particularly prior to filling the spaces between the casting forms and the insulating layer with structural material.

It is another object and feature of the invention to provide connectors that restrain motion of the casting forms and also serve the dual purpose of securing the composite wall structure together upon hardening of the structural layers.

It is yet another object and feature of the invention to provide connectors that are themselves relatively insulating in order to not create a thermal bridge through the composite wall structures.

It is a further object and feature of the invention to provide connectors that also may be manufactured at a relatively low cost per unit.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
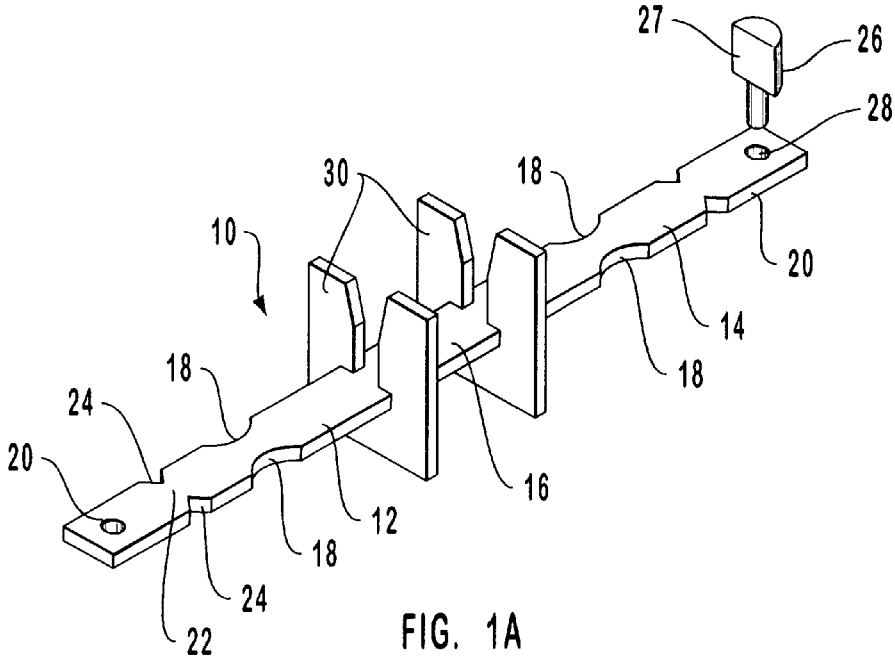
FIG. 1A is a perspective view of a preferred connector according to the invention.

The present invention is directed to connectors used in the manufacture of composite wall structures, particularly composite wall structures having an insulating layer positioned between a pair of structural layers. During the manufacture of a composite wall structure, the connectors rigidly secure forms in a spaced-apart relation on either side of the insulating layer. As concrete or other hardenable material is poured into the spaces between the insulating layer and the forms, the connectors prevent the unhardened material from pushing the forms out of position. Optionally, the connectors include features to prevent inward movement or collapse of the forms.

The connectors preferably include an elongate shaft comprising a first anchor segment, a second anchor segment, and a mesial segment therebetween. Extending outwardly from each of the first and second anchor segments is a respective form retention segment. In the composite wall structure set-up assembly, prior to pouring structural material between the forms, the mesial segment of the elongate shaft will extend through the insulating layer and the form retention segments will extend through holes in the forms. The anchor segments will reside substantially within molding spaces defined by the insulating layer and casting forms. The form retention segments extending through the forms will include locking means associated therewith having a bearing surface for inhibiting outward lateral movement of the forms once the inventive connectors have been locked in place.

When the concrete or other hardenable material has been poured and cured, the forms are typically removed from the composite structural wall, leaving at least a portion of the form retention segments protruding from the surface of the structural layers. The protruding portions of the connectors can be easily detached by striking them with a hammer or a chisel or by using a saw or snips. The connectors otherwise remain integrally positioned within the composite wall structure. Recesses, protrusions, or other structures preferably formed on the first and second anchor segments provide means for anchoring the connectors within the structural layers in order to thereby maintain the structural integrity of the composite wall structure by maintaining the desired spacial relationship between the layers. Moreover, the connectors are preferably formed from an insulative material so as to maintain good thermal resistance across the composite wall structure.

As used herein, the various segments of the connector are defined according to the portion of the composite wall structure in which they may be positioned. In particular, the first anchor segment and the second anchor segment are defined as the connector portions that reside within structural layers of the final composite wall structure. The first anchor segment is disposed in a structural layer on one side of the insulating layer of the composite wall structure, while the second anchor segment is disposed in another structural layer on the opposite side of the insulating layer. Likewise, the mesial segment is defined as the connector portion that resides within the insulating layer of the composite wall structure.

Depending on the configuration of the composite wall structure with which the connectors are to be used, the connectors may include a form retention segment at one or both ends of the elongate shaft. An example of a use for connectors within the scope of the invention that only include a form retention segment at one end of the connector is where an insulating layer and one or more structural layers are to be formed into a composite wall structure adjacent an existing wall. In that case, the connector will preferably include structure (i.e., a threaded tip) at the end opposite the form retention segment for mechanically securing the connector to the existing wall. The existing wall may comprise, for example, concrete, metal, wood, stucco, glass, and many other known building materials.

The connectors of the invention, including those illustrated in FIGS. 1A–1D, are preferably formed from a relatively highly insulative, or high R value, thermoplastic or thermoset material. Thus, when the connectors are used in composite wall structures, the flow of thermal energy through the connectors is minimized, or at least greatly reduced, so that the composite wall structures are relatively highly insulative. One thermoplastic material that is presently preferred is polyphenylsufone resin due to its excellent resistance to chemical attack and heat resistant characteristics. Another preferred thermoplastic material is a polyphthalimide, which is less expensive than polyphenylsulfone resins but somewhat less heat resistant.

Other preferred thermoplastic materials having a relatively high thermal resistance include polyamides, polyarylsulfones, polycarbonates, polyphthalamides, polysulfones, polyphenylsulfones, polyethersulfones, and aliphatic polyketones. Less preferred thermoplastics that are nevertheless adequate for most applications include acrylics, polyethylene, polypropylene, acrylonitrile-butadiene-styrene copolymers, polyfluorocarbons, polybutadienes, polybutylene teraphthalates, polyesters, polyethylene teraphthalates, polyphenylene ethers, polyphenylene oxides, polyphenylene sulfides, polyphthalate carbonates, polypropylenes, polystyrenes, polyurethanes, polyvinyl chlorides, and polyxylenes.

Preferred thermoset resins include polyester and vinyl esters. Other suitable thermoset materials include diallyl phthalates, epoxy resins, furan resins, and phenolic resins. The foregoing lists are illustrative and not limiting. In addition, copolymers and combinations of the foregoing materials may be used. The criteria used to select the material include sufficient strength and flexibility in order to avoid failure, a sufficiently high R value such that the composite wall structure is adequately insulative, cost, and moldability.

Depending on the particular plastic or resin used to form the connector and the desired structural properties of the finished product, reinforcing fibers such as glass fibers, carbon fibers, boron fibers, ceramic fibers, cellulosic fibers, nylon fibers, other polymeric fibers and the like may be interspersed within the material in order to increase the tensile strength, bending strength, toughness, and shear strength of the connectors. If the connectors have adequate strength in the absence of fibers, however, it will generally be more cost efficient to exclude fibers in most cases.

The connectors of the invention are preferably formed by injection molding in a single step or, alternatively, by a small number of steps that preferably include an injection molding step. Optionally, the injection molding step may be replaced by resin transfer molding, reaction injection molding, or any other single-step or relatively simple molding process. An important criterion is that the costs of the molding process be commensurate with the overall cost parameters of the connector that is to be formed. Using injection molding of resins or plastics provides connectors having adequate tensile, shear, and bending strength, and has the benefit of being relatively cost-effective. In contrast, other available methods of manufacturing such as pultrusion are not as favored, due to the need for subsequent machining steps in some cases. however, pultrusion can be advantageously employed if cost effective for a given connector design, particularly where the cross-section is relatively constant along the length of the connector.

Referring to FIG. 1A, in a first preferred configuration of connectors of the present invention, the connector 10 has an elongate shaft which has a generally rectangular cross section and includes a first anchor segment 12, a second anchor segment 14, and a mesial segment 16 positioned therebetween. In addition, form retention segments 20 extend from either anchor segments 14 and 12. The elongate shaft may alternatively have any of a wide range of cross-sectional shapes, including those illustrated in FIGS. 1A–1D. Possible cross-sectioned shapes include rectangular, square, round, elliptical, star, pentagon, hexagon, cruciform, combinations thereof, and virtually any other conceivable cross-sectional shape. Different shapes may provide advantages in the formation, placement, strength, flexibility, and other important engineering factors of both the connectors and composite wall structures made therewith.

When connector 10 is used in a composite wall structure, one preferred function of the connector is to tie together the structural layers and the insulating layer. Recesses 18, which are formed in first anchor segment 12 and second anchor segment 14, are one example of anchoring means for mechanically locking the connector within a structural layer of the composite wall structure. The cross sectional area of connector 10 is reduced at recesses 18, thereby providing a region into which unhardened concrete or other hardenable material can flow during formation of the structural layer. Once the hardenable material has hardened, the portion of the material positioned within recesses 18 mechanically prevents axial motion of connector 10 so that the connector resists being retracted from, or driven further through, the composite wall structure.

In alternative embodiments, the anchoring means, when included in the invention, may comprise any recess, notch, protrusion, or the like that either increases or decreases the cross sectional area or otherwise changes the cross sectional profile of the first anchor segment or the second anchor segment of the connectors. More generally, the anchoring means can be any structure formed on the first or second anchor segment that provides mechanical interference or interlocking between the elongate shaft and the structural layer when a force is applied that would otherwise tend to retract the connector from the structural layer. A textured or roughened surface may provide adequate mechanical anchoring between the connectors and the hardened structural layers in most cases.

A further example of anchoring means includes an adhesive material or other chemical treatment disposed on the surface of one or more of the anchor segments that promotes an adhesive bond with the structural material of the composite wall structure. Any of a variety of adhesives known in the art can be advantageously employed in order to promote an adhesive bond between the anchor segments of the inventive connectors and hardened structural material. A particularly preferred adhesive bond promoting material is a partially cured thermoset resin applied to the surface of the connector. In many cases, heat generated by the curing concrete material and/or heating of the concrete material by ambient conditions such as sunlight can serve to further cure the thermoset resin on the surface of the connectors after being placed within the concrete materials.

Another means for promoting an adhesive bond between the connectors and the hardening structural material includes surface treating the connectors prior to use with a solvent that can partially soften the surface of the connectors or otherwise aid in forming an adhesive bond between the connectors and hardened structural material. Suitable solvents that can be used for this purpose include, but are not limited to, methyl ethyl ketone, cylclohexanone, tetrahydrofuran, acetone, ethyl acetate, methyl alcohol, and the like.

It has even been found that connectors having no special mechanical features for anchoring and which have not been treated with any adhesion promoting materials can nevertheless form an adequate bond between the anchor segments and hardened structural materials such as concrete. It has been found that the inherent bond between the inventive connectors and concrete is adequate in many cases to firmly retain the anchoring segments of the connectors within the respective structural layers. Although there might be some tendency for the connectors to experience a pull-out effect prior to connector failure, there will be no actual pull-out depending on the frequency of connectors within the composite wall structure. So long as the cumulative strength of the bonds of the connectors within a particular region are stronger than the forces exerted by relative movement of the structural layers, there will be little if any pull-out of the connectors in many cases. Moreover, whereas it may be desirable for at least some of the connectors to be firmly mechanically anchored within the structural layers, it may be desirable to allow a portion of the connectors to have some pull-out effect in order to allow a degree of relative movement, such as by thermal expansion or contraction of the structural layers. One of ordinary skill in the art will know whether or not particular connectors will likely experience a pull-out effect and will be able to know beforehand whether or not such pull-out is desired or should be prevented.

The form retention segments of preferred connectors are capable of being easily detached after the composite wall structure has been formed. In one embodiment, detachable form retention segments are preferably integrally attached to the elongate shaft at or near a localized area of reduced strength at a position on the connector that preferably generally corresponds to the outer surface of the structural layer. In particular, form retention segments may be conveniently removed when the connector has a localized mechanical strength at the localized area less than the mechanical strength of adjacent portions of the form retention segment and the elongate shaft. When this is the case, stress applied to the connector by, for example, striking the form retention segment with a hammer or chisel tends to cause the form retention segment to more easily break off or otherwise separate from the connector at a desired breaking point location.

As illustrated in FIG. 1A, connector 10 has a neck 22 at the interface between form retention segment 20 and first anchor segment 12, which is one example of means for facilitating detachment of the form retention segment. Neck 22 is defined by notches 24 formed in the elongate shaft of the connector. The reduced cross sectional area at neck 22 and stress risers associated with the angled surfaces within notches 24 combine to create a localized area of reduced strength at the neck. In many embodiments, however, the plastic connectors will tend to be inherently weak enough to allow detachment of the retention segments without a specific weak interface or other localized area of reduced strength. Moreover, protruding connector ends may be advantageously sawed or snipped off using an appropriate severing tool.

In many implementations of the invention, form locking means for substantially preventing lateral outward motion of the forms are advantageously used in conjunction with the form retention segments. Removable form locking means associated with the form retention segment, one example of which is pin 26 of FIG. 1A, provides a bearing surface 27 configured to abut a form during formation of the composite wall structure. In order to allow the form locking means to securely abut the forms, the form retention segment 20 further includes means for mechanically attaching the form locking means to the connector. In FIG. 1A, the means for attaching the form locking means comprises a hole 28 passing through form retention segment 20. It should be understood that virtually and structure that can result in a bearing surface, or which in any way can mechanically interact with and prevent undesired movement of the casting forms, may comprise "form locking means" within the scope of the invention. Nonexclusive examples include pins, screws, nuts, washers, flanges, brackets, and even resins, glues and other initially flowable materials that can solidify to form a barrier to movement of the forms relative to the connectors.

Figure 3:
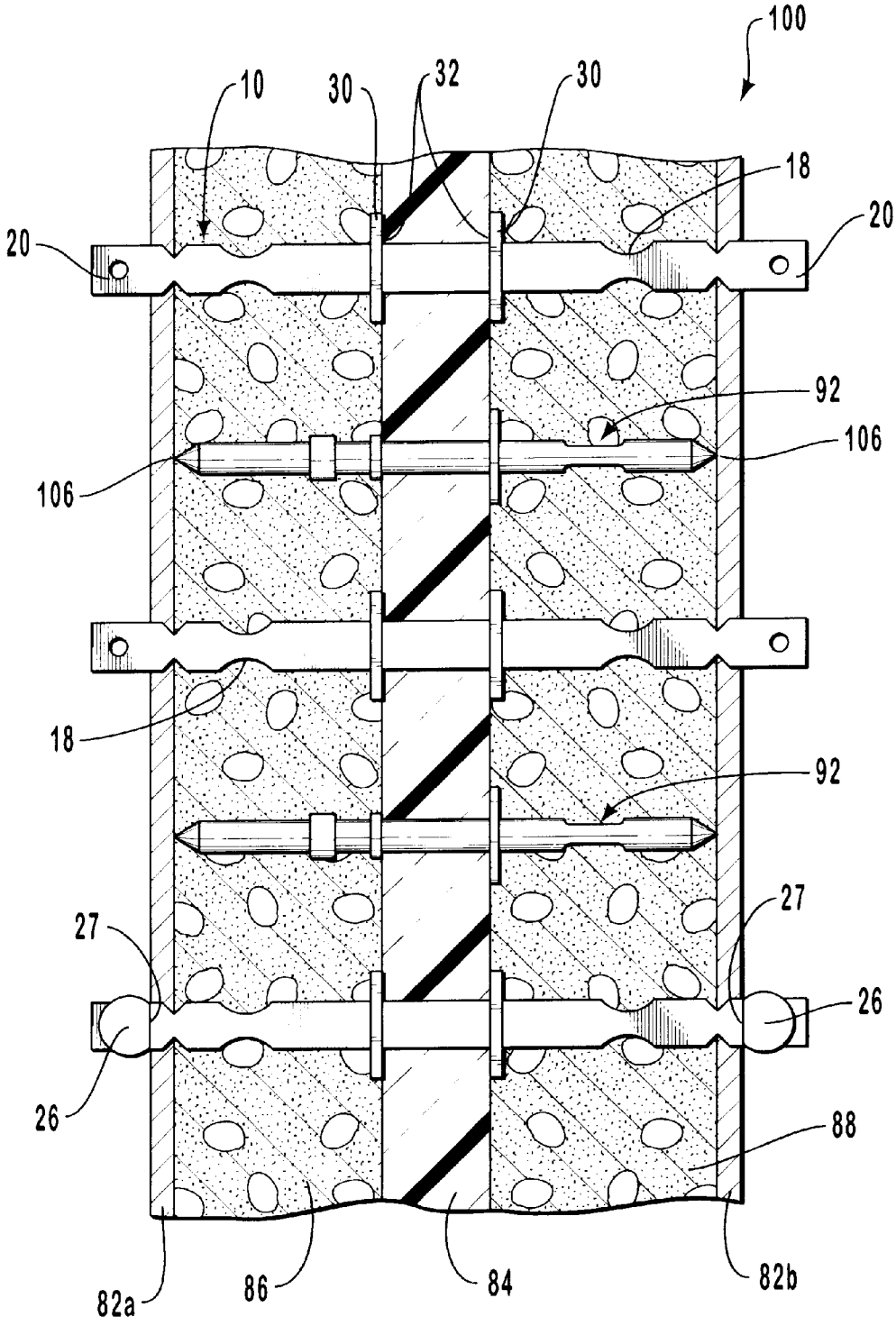
FIG. 3 is a cross-sectional plan view of a composite wall structure being formed using another preferred set-up assembly depicted using connectors illustrated in FIG. 1A and auxiliary connecting devices that reside within the region defined by the casting forms.

FIG. 1A illustrates several optional features of the connectors of the invention. Connector 10 has attached thereto bracket structures 30, the function of which is to maintain the insulating layer in a desired space-apart relationship with the casting forms. The bracket structures are, in most cases, preferably formed separately from the connector and are fitted onto the elongate shaft before or after the elongate shaft has been inserted through the insulating layer. Referring to FIG. 3, the bracket structures provide a bearing surface 32 in contact with an insulating layer (i.e., insulating layer 84 of FIG. 3) when connector 10 is used in composite wall structure 100. Furthermore, the bracket structures may optionally include reinforcement securing means (not shown) for securing reinforcing materials such as rebar, wire, or mesh (not shown) within the composite wall structure as the wall is being formed. Examples of preferred bracket structures and other reinforcement securing means that can be incorporated within, or used with the connectors of the present invention, are disclosed in copending U.S. application Ser. No. 09/020,599, filed Feb. 4, 1998.

Figure 1B:
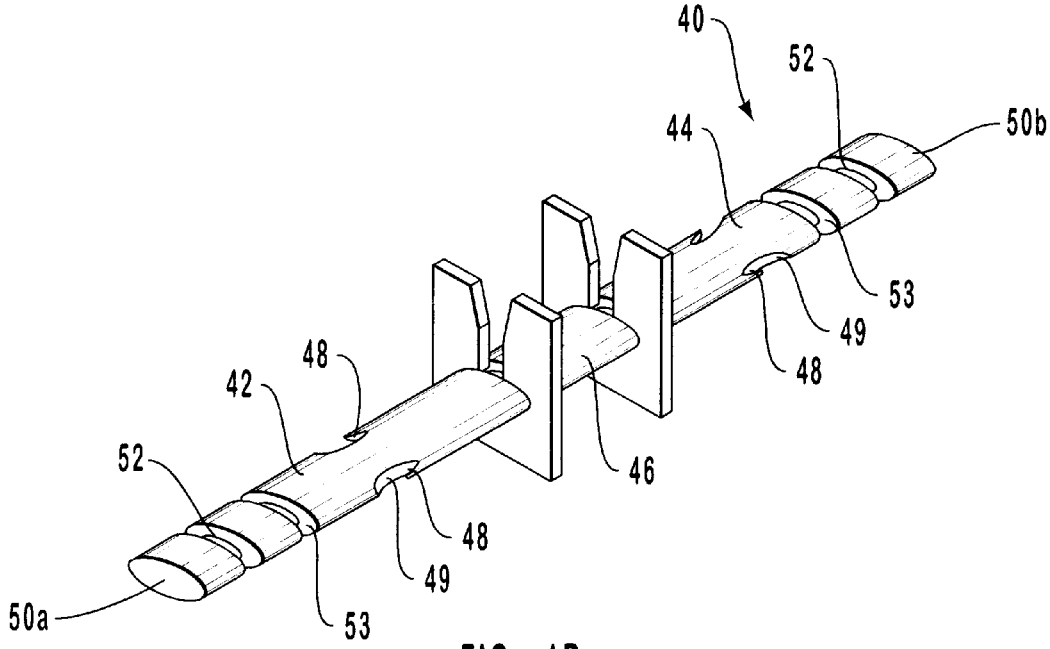
FIG. 1B is a perspective view of another connector according to the invention.
Figure 2:
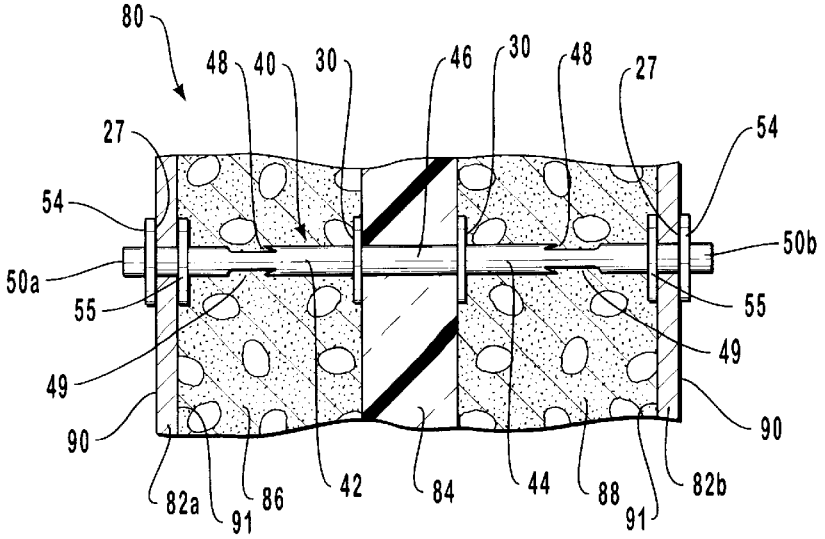
FIG. 2 is a cross-sectional elevation view of a composite wall structure being formed using a preferred set-up assembly, wherein connectors illustrated in FIG. 1B are shown.

FIGS. 1B and 2 illustrate a second preferred embodiment of the connectors of the present invention. Connector 40 has a generally elliptical cross section and includes a first anchor segment 42, a second anchor segment 44. mesial segment 46, and form retention segments 50*a* and 50*b*. Recesses 49, formed in first anchor segment 42 and second anchor segment 44, are further examples of anchoring means. Connector 40 also includes notches 48 formed within first anchor segment 42 and second anchor segment 44, which are an example of reinforcement securing means. Reinforcement materials, such as wire mesh, can be hooked or snapped into notches 48 prior to formation of the structural layers. Form retention segments 50*a* and 50*b* also include first annular recesses 52, which are used for attaching the form locking means to the connector. In this example, the form locking means comprises a locking washer 54, which is pressed over form retention segment 50*a* or 50*b* until it snaps into position within first annular recess 52 as shown in FIG. 2.

Connector 40 optionally includes second annular recesses 53 on first anchor segment 42 and second anchor segment 44 at a position that generally corresponds to the inner surfaces 91 of forms 82*a* and 82*b* of FIG. 2. Flanges 55, which are one example of means for preventing inward displacement of the forms, may be attached to second annular recess 53 before structural layers 86 and 88 are formed. Flanges 55 abut inner surfaces 91, thereby further rigidly securing forms 82*a* and 82*b* in a desired spaced-apart position relative to insulating layer 84, particularly within the composite wall structure set-up structure. Alternatively, instead of second annular recesses 53, any other means for attaching flanges 55 or other means for preventing inward displacement of the forms may be included. It is to be understood that the invention can be practiced in the absence of any connector features for preventing inward displacement of the forms.

Referring to FIG. 2, the function of the form locking means is further illustrated. When the composite wall structure 80 of FIG. 2 is constructed using the set-up structure depicted therein, holes are drilled or otherwise formed through forms 82*a* and 82*b* and insulating layer 84 so that connector 40 may pass therethrough. In order to place connector 40 in the position shown in FIG. 2, form retention segment 50*a* must have passed through the corresponding hole in form 82*a* or form retention segment 50*b* instead must have passed through the corresponding hole in form 82*b*. Assuming that form retention segment 50*a* has been inserted through form 82*a*, the corresponding hole in form 82*a* has a diameter at least the same size as the diameter of form retention segment 50*a*. To prevent subsequent retraction of form retention segment 50*a* through the corresponding hole in form 82*a*, form locking washer 54 (the embodiment of form locking means depicted in FIG. 2) is snapped onto form retention segment 50*a* after insertion of connector 40. Because locking washer 54 has a bearing surface 27 that abuts outer surface 90 of form 82*a*, washer 54 and form retention segment 50*a* prevent outward motion of form 82*a* when concrete or another hardenable material is applied to the composite wall structure.

Figure 1C:
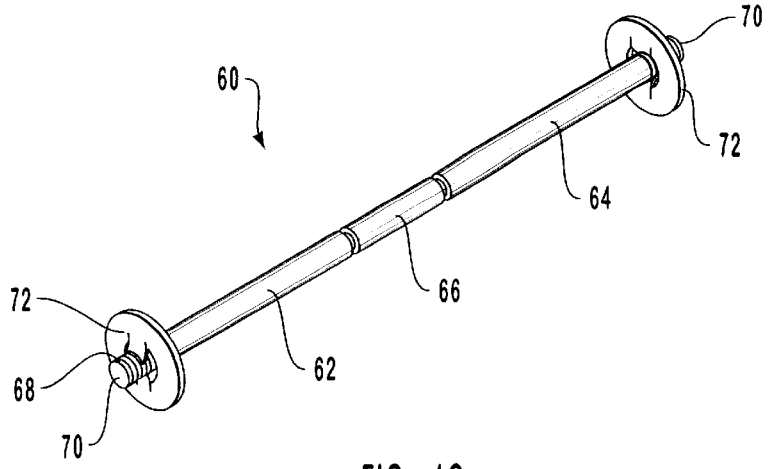
FIG. 1C is a perspective view of yet another connector according to the invention.

FIG. 1C illustrates a third preferred embodiment of the connectors of the invention. In this example, connector 60 includes a first segment 62, a second segment 64, a mesial segment 66, and form retention ends 70. In this embodiment, the means for attaching the form locking means to the connector includes a threaded surface 68 on form retention segments 70. Furthermore, the form locking means are depicted as comprising threaded washers 72 that may be quickly and easily slip-threaded over the threaded surface 68. In order to thereafter remove the forms, threaded washers 72 may be screwed off, or they may be cut, ground or snipped off as desired. Threaded washers 72 may advantageously include a protruding octagonal structure or they may themselves be octagonal to facilitate removal using a wrench.

Figure 1D:
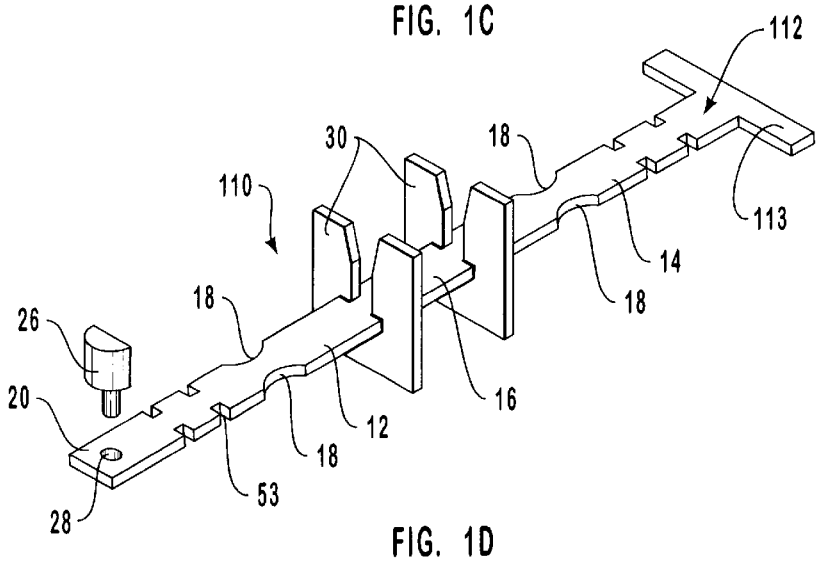
FIG. 1D is a perspective view of a further connector according to the invention.

Because first and second segments 62 and 64 depicted in FIG. 1C do not include any recesses or protrusions, but have a generally uniform profile, they do not include any mechanical anchoring means per se. Although less preferred in some cases, connectors that do not include mechanical anchoring means are within the scope of the invention. Although some adhesion between the connectors and structural layers is possible and may be adequate in many cases, it may be advantageous to treat first and second segments 62 and 64 with an adhesion promotor, such as an adhesive, partially cured thermoset resins, or solvents, as disclosed above, in order to improve the bond with the structural layers. Alternatively, auxiliary connecting devices 92 (FIG. 3) may be used in addition to the connectors depicted in FIG. 1C to provide the necessary function of tying the structural layers and insulating layer together. Some pull-out or slippage between at least some of the connectors and the hardened structural layers may be desirable in some cases, such as to allow for some relative movement of the structural layers without resulting in complete failure of the connectors. FIG. 1D depicts another alternative embodiment, in which connector 110 has a first form retention segment 112 having a locking structure 113 rigidly associated therewith. In order to use connector 110 in a composite wall structure, form retention segment 20 at the leading end of the connector 110 is inserted through the forms and the insulating layer. In this manner, form retention segment 112 and locking structure 113 will trail during placement and end up abutting one of the forms without passing through a form. A separate form locking means, such as pin 26, is thereafter placed within a hole 28 of form retention end 20. When the concrete or other hardenable material is poured into the molding spaces between the forms and the insulating layer, the locking structure 113 and pin 26 will substantially prevent the casting forms from further separating.

Figure 4:
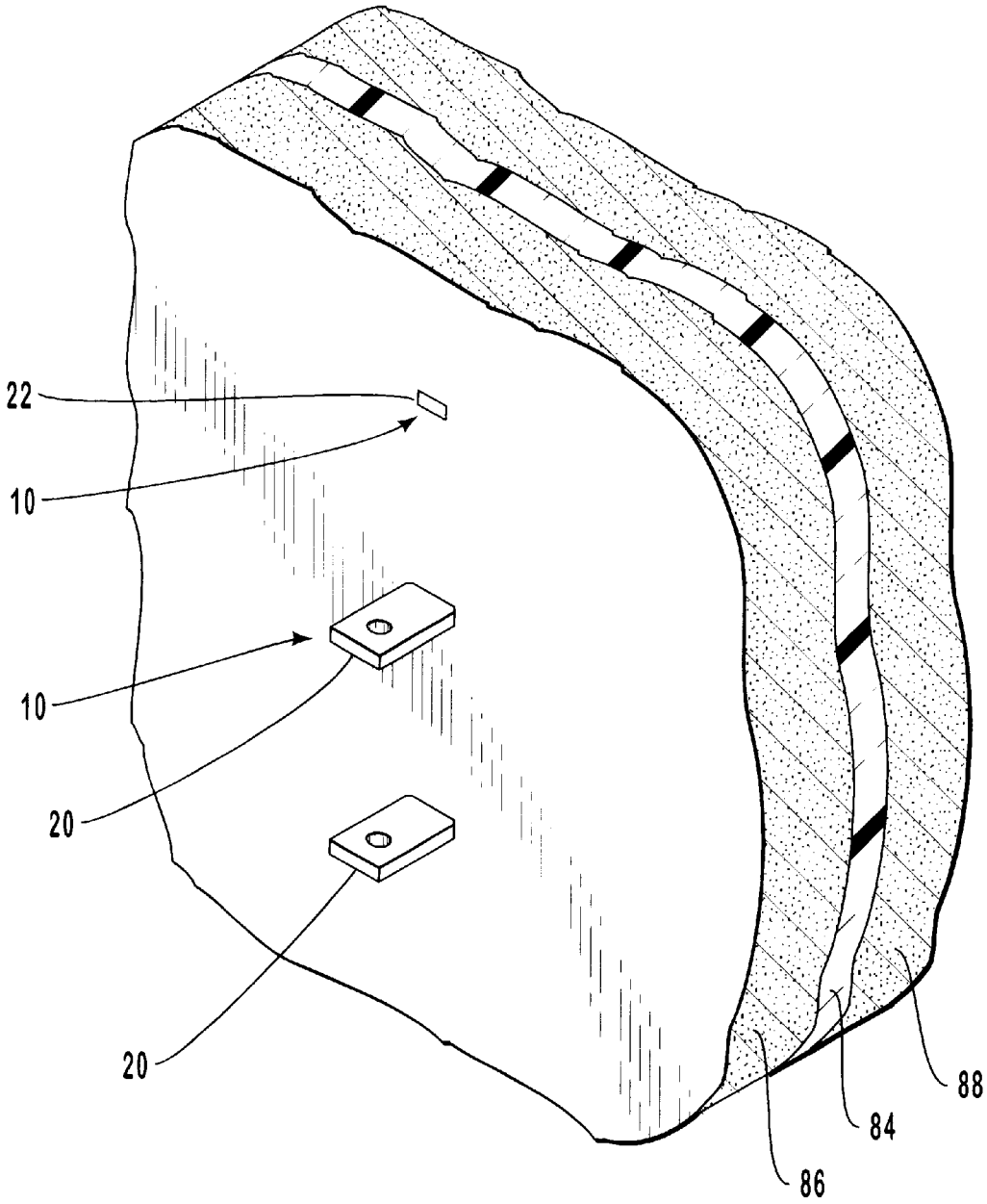
FIG. 4 is a partial perspective view of a composite wall structure formed according to the invention, showing the form retention segments of two connectors extending beyond the surface of a structural layer and the form retention segment of one of the connectors having been detached from the remainder of the connector.

Composite wall structures incorporating the connectors disclosed herein and methods for forming the composite wall structures may be understood by making reference to FIGS. 2–4. In particular, FIG. 2 illustrates a composite wall structure that is formed according to the "cast-in-place" method involving introducing concrete or other structural material within the set-up structure depicted therein. FIG. 3 shows another composite wall structure being formed within a set-up structure that includes a plurality of connectors illustrated in FIG. 1A in order to restrain motion of the forms in the direction away from the insulating layer and a plurality of auxiliary connecting devices 92 disclosed in U.S. Pat. No. 5,673,525 to Keith et al. in order to restrain motion of the forms in the direction toward the insulating layer.

FIG. 2 is a cross-sectional elevation view of a portion of a composite wall structure 80 having an insulating layer 84 positioned between a first structural layer 86 and a second structural layer 88. Composite wall structures incorporating connectors disclosed herein are most conveniently constructed using the cast-in-place method, although other known techniques may instead be used. In one embodiment, the composite wall structure 80 may be used as a structural wall of a commercial or residential building. Insulating layer 84 may be a panel formed from any of a wide variety of highly insulative materials that can be used in construction applications. Examples of suitable insulative materials include, but are not limited to, polystyrene foam, fiberglass, aerogel, xerogel, xonotlite, seagel, polyisocyanate foam, polyurethane foam, urea-formaldehyde foam, insulating cementitious materials, and mixtures of the foregoing.

In the cast-in-place method, insulating layer 84 and casting forms 82*a* and 82*b* are substantially vertically oriented, on a footing or otherwise, to form a set-up structure, preferably at or near where the composite wall structure is to be finally situated. The casting forms and insulating layer are preferably positioned so as to define molding spaces between the forms and insulating layer into which a hardenable structural material may be introduced. Forms 82*a* and 82*b* may comprise any suitable rigid panel formed from a material having a desired mechanical strength. A plurality of holes are formed through insulating layer 84 and forms 82*a* and 82*b* at the locations where connectors 40 are to be inserted. According to a preferred method, the holes are formed by advancing a drill bit of sufficient length consecutively through one of the forms 82*a* or 82*b*, insulating layer 84, and the other of forms 82*a* or 82*b*. Forming the holes in this manner ensures that the holes are properly aligned for receiving connector 40. Alternatively, the holes may be individually formed, either before or after forms 82*a* and 82*b* and insulating layer 84 have been vertically oriented, although this may increase the effort required to align the holes.

The number of connectors used in any of the embodiments disclosed herein should be sufficient to reliably bear the force directed onto the forms by the uncured concrete. The number and spacing of connectors will depend on the dimensions and mechanical properties of the connectors and the forms and on the size and mechanical requirements of the composite wall that is to be constructed.

After the holes are formed, connectors 40 are inserted therethrough until positioned substantially as illustrated in FIG. 2. In order to further secure the insulating layer in the desired position and/or to attach reinforcement materials to the connectors 40, bracket structures 30 may be advantageously snapped into place over connector 40. Depending on the desired structural properties of the composite wall structure, reinforcement materials such as rebar, metal cables, wires, natural and synthetic organic fibers, metal fibers, wire mesh, and the like can be attached to notches, hooks, or other suitable structures optionally formed on either the bracket structures or the connectors themselves. In addition, flanges 55 are optionally attached to connectors 40 as has been described herein.

Washers 54 or other form locking means are then attached to the corresponding form retention segments 50*a* and 50*b*, thereby preventing subsequent outward displacement of forms 82*a* and 82*b*. Concrete is poured within the molding spaces on either side of the insulating layer 84 to form first structural layer 86 and second structural layer 88. Alternatively, any of a number of other suitable hardenable structural materials may be used in place of concrete in this and other embodiments of the invention.

In order to avoid unduly stressing one side of the insulating layer 84 during formation of the structural layers 86 and 88, it is usually preferable to pour roughly equal depths of concrete within the molding spaces in order to substantially equalize the pressure being exerted on either side of the insulating layer 84 at any particular moment. As the concrete is poured into the molding spaces between insulating layer 84 and casting forms 82*a* and 82*b*, a considerable amount of pressure is exerted on the forms, which would tend to displace away from the insulating layer in the absence of connectors 40 and the form locking means such as washers 54. The bearing surfaces 27 of washers 54 prevent such displacement as has been described herein.

FIG. 3 illustrates another preferred embodiment of the composite wall structures of the invention, in which connector 10 or another connector disclosed herein is used to restrain outward motion of the forms 82*a* and 82*b* in the set-up structure, while an auxiliary connecting device 92 is used to restrain inward motion of the forms. It is noted that the distances between adjacent connectors 10 and connecting devices 92 were chosen for illustration purposes only. The inclusion of both auxiliary connectors 10 and auxiliary connecting devices 92, which remain integrally positioned in the completed composite wall structure 100, allows the relative position of the insulating layer 84 and the forms 82*a* and 82*b* to be conveniently selected and fixed before and during formation of the structural layers 86 and 88.

In a preferred method of forming composite wall structure 100 using the set-up structure depicted in FIG. 3, a plurality of connecting devices 92 are positioned substantially orthogonally through insulating layer 84 before it is situated between forms 82*a* and 82*b*. For example, the connectors disclosed in U.S. Pat. No. 5,673,525 to Keith et at. may be the connecting devices 92. Alternatively, the connectors disclosed in U.S. Pat. No. 4,829,733 to Long, or any number of other connectors, could be used in place of connecting devices 92. If connecting devices 92 have substantially pointed tips 106, they will result in the formation of a smoother outer surface of the composite wall structure 100 because concrete can more easily close around the pointed tips than a larger diameter end. Connecting devices 92 are included in the composite wall structure to structurally tie the completed wall together and to prevent the forms from collapsing inwardly during the manufacturing process. Accordingly, connecting devices 92 preferably have a length substantially equal to or less than the desired overall width of composite wall structure 100.

After the composite wall structures of FIGS. 2 and 3 have been formed, the forms 82*a* and 82*b* are preferably removed from the adjacent structural layers. In order to remove the forms, the form locking means must be generally removed from the connectors, either by separating them from the form retention segments or by breaking or cutting off at least a portion of the form locking means, and perhaps part of the form retention segment, to release the forms. For example, in FIG. 3, pins 26 may be removed from the respective holes in form retention segments 20, thus allowing the forms to be pulled away from the composite wall structure 100.

FIG. 4 illustrates composite wall structure 100 in perspective view with forms 82*a* and 82*b* having been removed therefrom, leaving form retention segments 20 extending from the outer surface of first structural layer 86. In order to provide a reasonably smooth outer surface of first structural layer 86, form retention segments 20 can be advantageously detached from the remainder of connector 10 and composite wall 100. In FIG. 4, the form retention segment of the uppermost illustrated connector 10 has been detached from the remainder of the connector. As described above in reference to FIG. 1A, the connectors of the invention may have a locally weak region to facilitate detachment of the form retention segments. Detachment may be accomplished by striking form retention segment 20 with a hammer so as to apply stress thereto sufficient to cause form retention segment 20 to break away from the remainder of connector 10 at neck 22. Alternatively, other tools, including chisels, saws, snips, and the like may be used to remove form retention segments 20. It is to be understood that form retention segments 20 ordinarily also protrude from the outer surface of second structural layer 88, which is not visible in FIG. 4.

While the composite wall structures specifically illustrated herein include two structural layers and two forms, it should be understood that the connectors and the methods for forming composite walls may be adapted for other structures. For example, depending on the environment in which the composite wall structure is to be constructed, there may be the need for restraining the motion of only one form. Such situations may arise when the composite wall structure is to be formed directly against a permanent structure that serves as the second form.

Figure 5A:
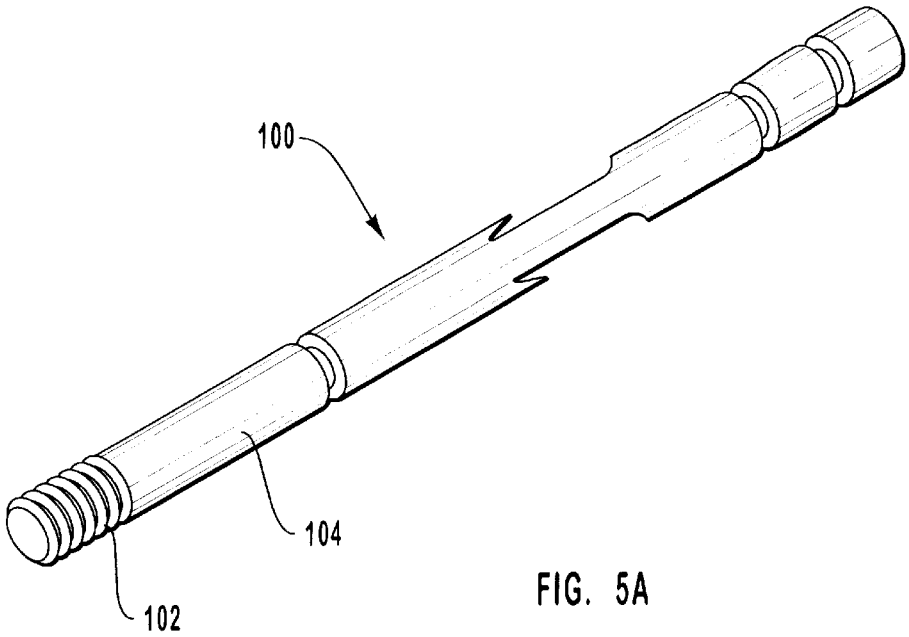
FIG. 5A is perspective view of a connector having a threaded end for connecting to an existing wall.
Figure 5B:
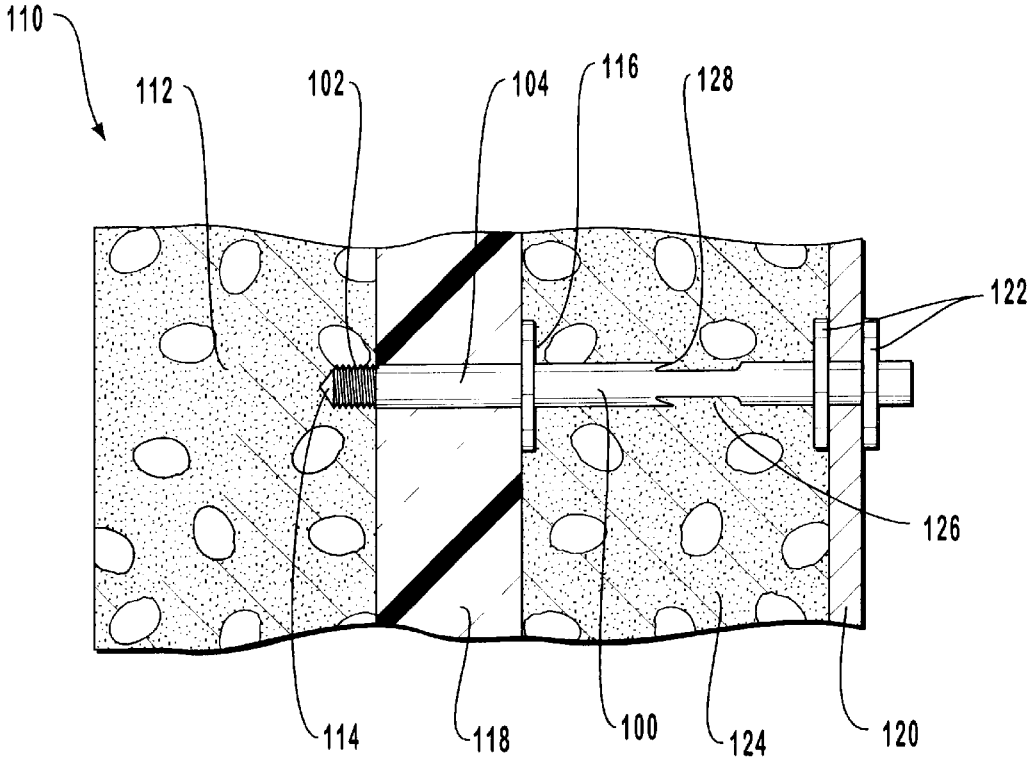
FIG. 5B is a perspective view of the connector depicted in FIG. 5A having been used to form a composite wall structure using an existing wall.

For example, FIGS. 5A and 5B depict a connector for use in forming a composite wall structure directly against an existing wall. In particular, FIG. 5A depicts an illustrative connector 100, which is essentially identical to the connector 44 depicted in FIGS. 1B and 2, except for the following. First, the connector 100 includes a threaded tip 102 at one end. Second, the connector 100 has a cylindrical profile like the connector 60 depicted in FIG. 1C, rather than an ellipsoidal profile, so as to facilitate formation of the threaded tip 102. Third, since the connector 100 is used to form a composite wall structure directly against an existing wall, the connector 100 eliminates unnecessary structures between the threaded tip 102 and a mesial segment 104. The connector 100 may be threadably attached to an existing wall, such as a wall made of concrete, metal, wood, stucco, glass, or other known building material.

FIG. 5B illustrates how the connector 100 may be used to form a composite wall structure 110 directly against an existing wall 112, which is shown in FIG. 5B as being made of concrete. The threaded tip 102 is threaded into a corresponding recess 114 in the existing concrete wall 112. As in FIG. 2, a bracket structure 116 may be used to retain an insulating layer 118 next to the existing wall 112. A casting form 120 may be maintained in a desired spaced-apart relationship relative to the insulating layer 118 by means of locking washers 122 so as to facilitate formation of a structural layer 124 from a hardenable structure material, such as concrete, within a space between the insulating layer 118 and casting form 120. A recess 126 in the connector 100 assists in anchoring the connector 100 within the structural layer 124 upon hardening of the hardenable structural material. A notch 128 provides optional reinforcement securing means for securing a reinforcement material to the connector 100, such as wire mesh (not shown). Alternatively, the composite wall structures may include only one structural layer and one associated insulating layer. In this case, the connectors of the invention will be used to secure only a single form with respect to the insulating layer.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A connector for use in the manufacture of a composite wall structure comprising:

an elongate shaft including:

a form retention segment disposed at an end thereof and positionable through a passage within a casting form;

a mesial segment positionable through a passage within an insulating layer when the insulating layer is in a desired spaced-apart relationship with the casting form; and an anchor segment disposed between said form retention segment and said mesial segment and positionable within a space between the insulating layer and the casting form for placement of a layer of a hardenable structural material within said space during manufacture of a composite wall structure, wherein at least the mesial segment of the elongate shaft comprises a material having a high thermal resistance;

retention means, removably attached to the elongate shaft adjacent to the mesial segment, for preventing significant movement of the insulating layer relative to the elongate shaft in at least one axial direction; and form locking means, associated with the form retention segment, for preventing substantial movement of the casting form relative to the elongate shaft in at least one axial direction.

2. A connector as defined in claim 1, wherein the elongate shaft further includes a wall attachment structure disposed at an end of the elongate shaft opposite of said form retention segment and configured so as to secure the connector to an existing wall.

3. A connector as defined in claim 1, wherein said anchor segment further includes means for anchoring said elongate shaft within a hardened layer of structural material.

4. A connector as defined in claim 1, further including form collapse prevention means, removalby attached to the elongate shaft adjacent said form retention segment, for preventing collapse of the casting form toward the insulating layer.

5. A connector as defined in claim 1, wherein the elongate shaft further includes:

a second form retention segment disposed at an end of said elongate shaft opposite of said form retention segment and configured so as to be positionable through a passage within a second casting form when the second casting form is in a desired spaced-apart relationship with the insulating layer; and a second anchor segment disposed between said second form retention segment and said mesial segment and positionable within a space between the insulating layer and the second casting form for placement of a second layer of a hardenable structural material within said space between the insulating layer and the second casting form during manufacture of a composite wall structure.

6. A connector as defined in claim 5, further including:

first form collapse prevention means, removably attached to the elongate shaft adjacent to said form retention segment, for preventing collapse of the casting form toward the insulating layer; and second form collapse prevention means, removably attached to the elongate shaft adjacent to said second form retention segment, for preventing collapse of the second casting form toward the insulating layer.

7. A connector as defined in claim 2, wherein the wall attachment structure comprises a threaded portion of the elongate shaft at an end opposite said form retention segment.

8. A connector for use in manufacturing a composite wall structure comprising:

an elongate shaft including:

a first form retention segment disposed at an end thereof and positionable through a passage within a first casting form;

a second form retention segment disposed at an end opposite said first form retention segment and positionable through a passage within a second casting form when positioned in a desired spaced-apart relationship with the first casting form;

a mesial segment positionable through a passage within an insulating layer when the insulating layer is in a desired spaced-apart relationship between the first and second casting forms;

a first anchor segment disposed between said first form retention segment and said mesial segment and positionable within a first space between the insulating layer and the first casting form for placement of a first layer of a hardenable structural material within said first space during manufacture of a composite wall structure; and a second anchor segment disposed between said second form retention segment and said mesial segment and positionable within a second space between the insulating layer and the second casting form for placement of a second layer of a hardenable structural material within said second space during manufacture of the composite wall structure, wherein at least the mesial segment of the elongate shaft comprises a material having a high thermal resistance;

at least one retention bracket removably attached to the elongate shaft adjacent to the mesial segment for preventing significant movement of the insulating layer relative to the elongate shaft in at least one axial direction;

at least one form locking structure associated with the first form retention segment for preventing significant movement of the first casting form relative to the elongate shaft in at least one axial direction; and at least one other form locking structure associated with the second form retention segment for preventing significant movement of the second casting form relative to the elongate shaft in at least one axial direction.

9. A connector as defined in claim 8, wherein at least one of the anchor segments further includes means for anchoring the elongate shaft within a corresponding hardened layer of structural material.

10. A connector as defined in claim 9, wherein the anchoring means comprises at least one of a recess, a protrusion, or a textured surface on at least one of the anchor segments.

11. A connector as defined in claim 9, wherein the anchoring means comprises adhesion means for promoting improved adhesion or bonding between at least one of the anchor segments and a hardened layer of a structural material.

12. A connector as defined in claim 11, wherein the adhesion means comprises at least one of an adhesive, a partially cured thermoset resin, or a solvent capable of softening the connector when applied thereto.

13. A connector as defined in claim 8, wherein the elongate shaft includes a localized area of reduced strength adjacent to at least one of the form retention segments in order to facilitate separation of the form retention segment from the elongate shaft upon formation of the composite wall structure and removal of the corresponding form.

14. A connector as defined in claim 8, wherein the form locking structure includes a projection that mates with a corresponding hole within the form retention segment.

15. A connector as defined in claim 8, wherein the form locking structure comprises a flange configured to mate with a corresponding groove within the form retention segment.

16. A connector as defined in claim 8, wherein one of the form locking structures is integrally affixed to the corresponding form retention segment and includes a bearing surface that makes abutment with a corresponding casting form during formation of a composite wall structure, wherein the other of the form locking structures is removably attached to the form retention segment and includes a bearing surface that makes abutment with a corresponding casting form during formation of the composite wall structure.

17. A connector as defined in claim 8, further including collapse prevention means, removably attached to the elongate shaft adjacent at least one of the form retention segments, for preventing significant movement of at least one of the casting forms toward the insulating layer when in a desired spaced-apart relationship.

18. A connector as defined in claim 8, wherein the connector includes two retention brackets removably attached to the elongate shaft adjacent to either side of the mesial segment and which together prevent significant movement of the insulating layer relative to the elongate shaft in either axial direction.

19. A connector as defined in claim 8, further including reinforcement securing means, disposed on said elongate shaft, for securing a reinforcement material in a relatively fixed position relative to the elongate shaft during formation of the composite wall structure.

20. A connector as defined in claim 8, wherein at least a portion of the connector is formed from at least one of a polyamide, a polyarylsulfones, a polycarbonate, a polyphthalamides, a polysulfone, a polyphenylsulfone, a polyethersulfone, an aliphatic polyketone, an acrylic, polyethylene, polypropylene, an acrylonitrile-butadiene-styrene copolymer, a polyfluorocarbon, polybutadiene, polybutylene teraphthalate, a polyester, polyethylene teraphthalate, a polyphenylene ether, a polyphenylene oxide, a polyphenylene sulfide, a polyphthalate carbonate, polypropylene, polystyrene, polyurethane, polyvinyl chloride, polyxylene, a vinyl ester, a diallyl phthalate, an epoxy resin, a furan resin, or a phenolic resin.

21. A set-up structure used in the manufacture of an insulating composite wall structure having an insulating layer disposed between a pair of adjacent structural layers, the set-up structure comprising:

first and second casting forms in a desired spaced-apart relationship defining a region therebetween;

an insulating layer substantially disposed in the region between the casting forms, wherein the insulating layer and casting forms define a pair of respective molding spaces into which a hardenable structural material can be introduced in order to form corresponding structural layers; and a plurality of connectors passing through the insulating layer and casting forms, each connector including:

an elongate shaft;

a first form retention segment disposed at an end of said elongate shaft and positioned through a passage within the first casting form;

a second form retention segment at an end of said elongate shaft opposite said first form retention segment and positioned through a passage within the second casting form;

a mesial segment disposed between the first and second form retention segments and positioned through a passage within the insulating layer;

a first anchor segment disposed between said first form retention segment and said mesial segment and positioned within one of said molding spaces; and a second anchor segment disposed between said second form retention segment and said mesial segment and positioned within another of said molding spaces, wherein at least the mesial segment of the elongate shaft comprises a material having a high thermal resistance;

at least one retention bracket removably attached to the elongate shaft adjacent to the mesial segment which prevents significant movement of the insulating layer relative to the elongate shaft in at least one axial direction;

at least one form locking structure associated with the first form retention segment which prevents significant movement of the first casting form relative to the elongate shaft in at least one axial direction; and at least one other form locking structure associated with the second form retention segment which prevents significant movement of the second casting form relative to the elongate shaft in at least one axial direction.

22. A set-up structure as defined in claim 21, further including a plurality of auxiliary connector devices residing in the region between the casting forms, each auxiliary connector device being formed from a material having a relatively high thermal resistance and including a shaft, the shaft further including one or more anchoring structures disposed thereon and positioned so as to reside within the molding spaces and a middle section positioned so as to reside within the insulating layer.

23. A connector for use in manufacturing a composite wall structure comprising:

an elongate shaft including:

a form retention segment disposed at an end thereof and positionable through a passage within a casting form;

a mesial segment positionable through a passage within an insulating layer when the insulating layer is in a desired spaced-apart relationship between the casting form and existing wall; and an anchor segment disposed between said form retention segment and said mesial segment and positionable within a space between the insulating layer and the casting form for placement of a layer of hardenable structural material therein during manufacture of a composite wall structure, wherein at least the mesial segment of the elongate shaft comprises a material having a high thermal resistance;

an insulation retention structure removably attached to the elongate shaft adjacent to the mesial segment and configured so as to prevent significant movement of the insulating layer relative to the elongate shaft in at least one axial direction; and a form locking structure associated with the form retention segment and configured so as to prevent significant movement of the casting form relative to the elongate shaft in at least one axial direction.

24. A connector as defined in claim 23, wherein the elongate shaft further includes a wall attachment structure disposed at an end of the elongate shaft opposite said form retention segment and configured so as to secure the connector to an existing wall.

25. A connector as defined in claim 24, wherein the wall attachment structure comprises a threaded portion of the elongate shaft at an end opposite said form retention segment.

26. A connector as defined in claim 23, wherein the elongate shaft further includes:

a second form retention segment disposed at an end of said elongate shaft opposite said form retention segment and positionable through a passage within a second casting form when the second casting form is in a desired spaced-apart relationship with the insulating layer; and a second anchor segment disposed between said second form retention segment and said mesial segment and positionable within a space between the insulating layer and the second casting form for placement of a second layer of a hardenable structural material within said space between the insulating layer and the second casting form during manufacture of a composite wall structure.

* * * * *

UNITED STATES PATENT AND TRADEMARK OFFICE

CERTIFICATE OF CORRECTION

PATENT NO. : 6,138,981
DATED : October 31, 2000
INVENTOR(S) : David O. Keith; David M. Hansen It is certified that error appears in the above-identified patent and that said Letters Patent is hereby corrected as shown below:

Title page,
Item [56] References Cited, line 11, after "2,775,018 12/1956" change "McLauglin" to -- McLaughlin -- and line 31, before "2/1991 Germany." change "P 39 25 780" to -- P 39 25 780.0" (point zero)

Column 1,
Line 25, after "of such" delete [as]

Column 2,
Line 20, after "No. 4,829,733 to" change "long" to -- Long --
Line 36, after "structure" change "arc" to -- are --

Column 3,
Line 32, after "connectors" change "arc" to -- are --

Column 5,
Line 38, before "polystyrenes" insert -- , -- (comma)

Column 6,
Line 63, before "perspective" insert -- a --

Column 9,
Line 2, after "some cases." change "however" to -- However --

Column 11,
Line 6, before "a bearing surface" change "provides" to -- provide --
Line 14, after "that virtually" change "and" to -- any --
Line 46, before "mesial segment" change "." (period) to -- , -- (comma)

Column 12,
Line 5, before "set-up" delete [structure]

UNITED STATES PATENT AND TRADEMARK OFFICE

CERTIFICATE OF CORRECTION

PATENT NO. : 6,138,981
DATED : October 31, 2000
INVENTOR(S) : David O. Keith; David M. Hansen It is certified that error appears in the above-identified patent and that said Letters Patent is hereby corrected as shown below:

Column 13,
Line 2, before "Fig. 1D" begin a new paragraph

Column 14,
Line 64, after "Keith et" change "at." to -- al. --

Column 17,
Line 5, before "attached" change "removalby" to -- removably --

Column 19,
Line 6, after "polyamide, a" change "polyarylsulfones" to -- polyarylsulfone --
Line 7, before ", a polysulfone" change "polyphthalamides" to -- polyphthalamide --

Signed and Sealed this

Fifth Day of February, 2002

*Attest:*

*Attesting Officer*

JAMES E. ROGAN
*Director of the United States Patent and Trademark Office*